US009134641B2

(12) United States Patent
Sato

(10) Patent No.: US 9,134,641 B2
(45) Date of Patent: Sep. 15, 2015

(54) IMAGE FORMING APPARATUS

(75) Inventor: Masaki Sato, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 306 days.

(21) Appl. No.: 13/526,796

(22) Filed: Jun. 19, 2012

(65) Prior Publication Data

US 2012/0328331 A1 Dec. 27, 2012

(30) Foreign Application Priority Data

Jun. 21, 2011 (JP) ..... 2011-137488

(51) Int. Cl.
*G03G 15/08* (2006.01)
*G03G 15/01* (2006.01)
*G03G 21/16* (2006.01)

(52) U.S. Cl.
CPC ..... *G03G 15/0189* (2013.01); *G03G 21/168* (2013.01); *G03G 21/1633* (2013.01); *G03G 2221/1642* (2013.01); *G03G 2221/1684* (2013.01)

(58) Field of Classification Search
CPC ..... G03G 15/1605; G03G 2221/1642; G03G 21/16; G03G 2215/0119
USPC ..... 399/121, 302
See application file for complete search history.

(56) References Cited

FOREIGN PATENT DOCUMENTS

| | | | | |
|---|---|---|---|---|
| JP | 2000172086 | A | * | 6/2000 |
| JP | 2001-142319 | A | | 5/2001 |
| JP | 2001142319 | A | * | 5/2001 |
| JP | 2007-11212 | A | | 1/2007 |
| JP | 2007-133327 | A | | 5/2007 |
| JP | 2007240893 | A | * | 9/2007 |
| JP | 2011065191 | A | * | 3/2011 |

* cited by examiner

*Primary Examiner* — Erika J Villaluna
(74) *Attorney, Agent, or Firm* — Fitzpatrick, Cella, Harper & Scinto

(57) ABSTRACT

An image forming apparatus includes: a plurality of image bearing members, provided in parallel, each for forming a toner image; a first intermediary transfer member for forming a primary transfer portion between itself and each of the image bearing members, wherein the toner images formed on the image bearing members are to be primary-transferred onto the first intermediary transfer member; a second intermediary transfer member onto which the toner images are to be secondary-transferred from the first intermediary transfer member; and a transfer member for tertiary-transferring the toner images from the second intermediary transfer member onto a recording material. The first and second intermediary transfer members are integrally assembled into a transfer unit. The transfer unit is movable relative to a main assembly of the image forming apparatus in a direction in which the image bearing members are provided in parallel.

10 Claims, 10 Drawing Sheets

(a)

(b)

IMAGE FORMING APPARATUS

FIELD OF THE INVENTION AND RELATED ART

The present invention relates to an image forming apparatus such a copying machine or a laser beam printer.

A color image forming apparatus in which toner images formed on photosensitive drums of a plurality of process cartridges are primary-transferred onto an intermediary transfer member at a primary transfer portion and then are secondary-transferred from the intermediary transfer member onto a recording material at a secondary transfer portion has been conventionally known.

Further, a color image forming apparatus in which a second intermediary transfer member is used and the toner images are secondary-transferred from the intermediary transfer member onto the second intermediary transfer member at the secondary transfer portion and then are tertiary-transferred from the second intermediary transfer member onto the recording material at a tertiary transfer portion has been proposed by Japanese Laid-Open Patent Application (JP-A) 2001-142319. As in JP-A 2001-142319, by employing a constitution using the second intermediary transfer member, the color image forming apparatus has the advantage that a first print out time (FPOT) until a first recording material is outputted is shortened.

In some image forming apparatuses, the plurality of process cartridges, the intermediary transfer member and the like are demounted from an apparatus main assembly and then are replaced for maintenance or lifetime extension. Therefore, recent color image forming apparatuses are required to have a constitution in which the plurality of process cartridges, the intermediary transfer member and the like are easily demounted from the apparatus main assembly.

As in the constitution of JP-A 2001-142319, in the constitution using the second intermediary transfer member, an image forming step includes three transfer processes consisting of transfer from the image bearing member onto the first intermediary transfer member (primary transfer), transfer from the first intermediary transfer member onto the second intermediary transfer member (secondary transfer) and transfer from the second intermediary transfer member onto the recording material (tertiary transfer), it is very important to ensure positional accuracy between the first intermediary transfer member and the second intermediary transfer member. This constitution is accompanied with a problem that it is difficult to replace each of the first and second intermediary transfer members.

However, in JP-A 2001-142319, there is no disclosure as to a replacing method of and the positional accuracy between the first and second intermediary transfer members. Therefore, means for solving these problems has been required.

SUMMARY OF THE INVENTION

A principal object of the present invention is to provide an image forming apparatus capable of improving not only operativity during replacement of a first intermediary transfer member and a second intermediary transfer member but also positional accuracy between the first intermediary transfer member and the second intermediary transfer member.

According to an aspect of the present invention, there is provided an image forming apparatus comprising: a plurality of image bearing members, provided in parallel, each for forming a toner image; a first intermediary transfer member for forming a primary transfer portion between itself and each of the plurality of image bearing members, wherein the toner images formed on the plurality of image bearing members are to be primary-transferred onto the first intermediary transfer member; a second intermediary transfer member onto which the toner images are to be secondary-transferred from the first intermediary transfer member; and a transfer member for tertiary-transferring the toner images from the second intermediary transfer member onto a recording material, wherein the first intermediary transfer member and the second intermediary transfer member are integrally assembled into a transfer unit, and wherein the transfer unit is movable relative to a main assembly of the image forming apparatus in a direction in which the plurality of image bearing members are provided in parallel.

These and other objects, features and advantages of the present invention will become more apparent upon a consideration of the following description of the preferred embodiments of the present invention taken in conjunction with the accompanying drawings.

Figure 5:
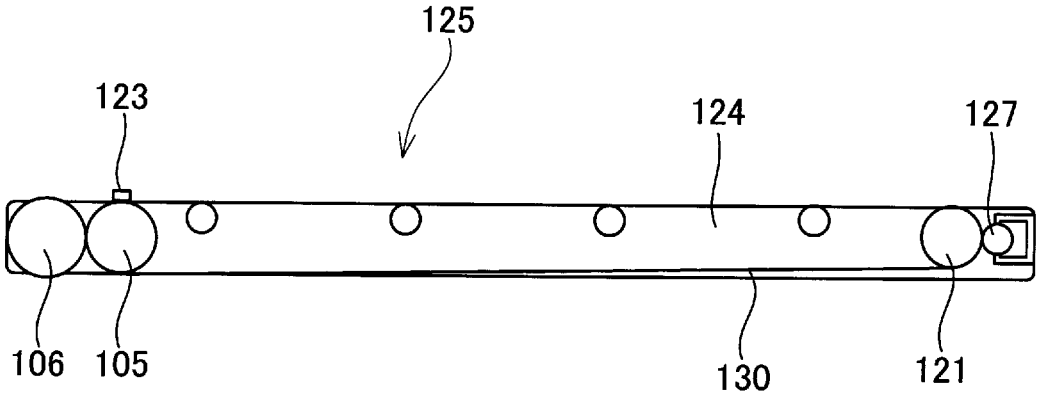
Figure 5:
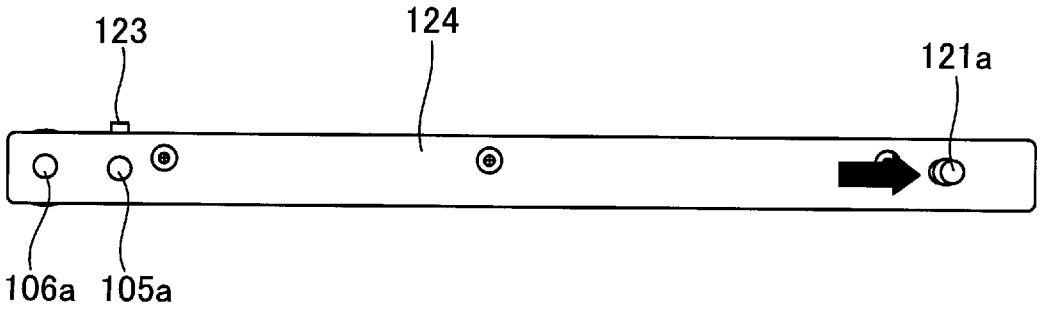

Parts (a) and (b) of FIG. 5 are schematic sectional views of a transfer unit in Embodiment 1.

Figure 6:
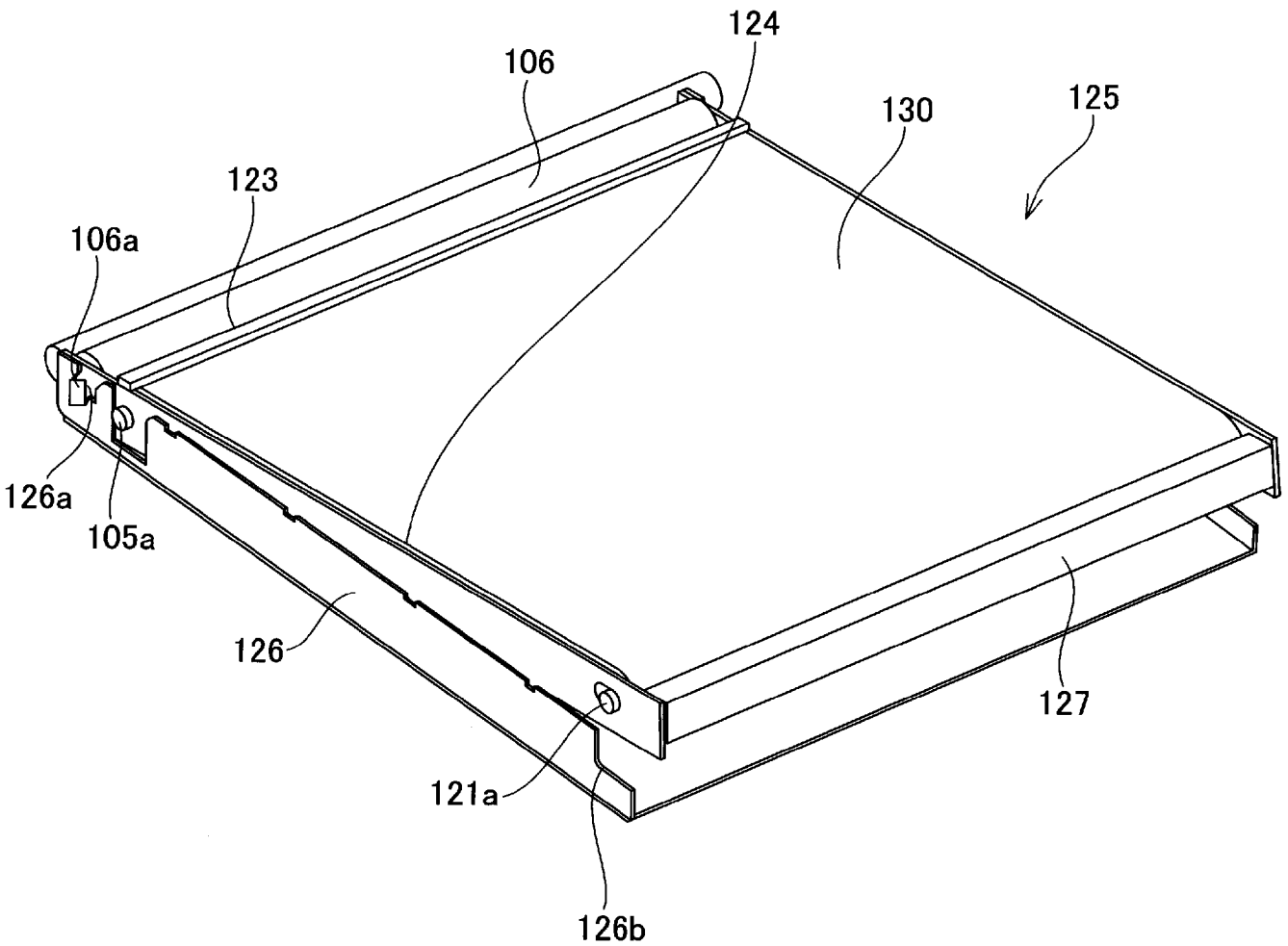

FIG. 6 is a perspective view showing a relationship between the transfer unit and a positioning portion of an apparatus main assembly frame in Embodiment 1.

Figure 7:
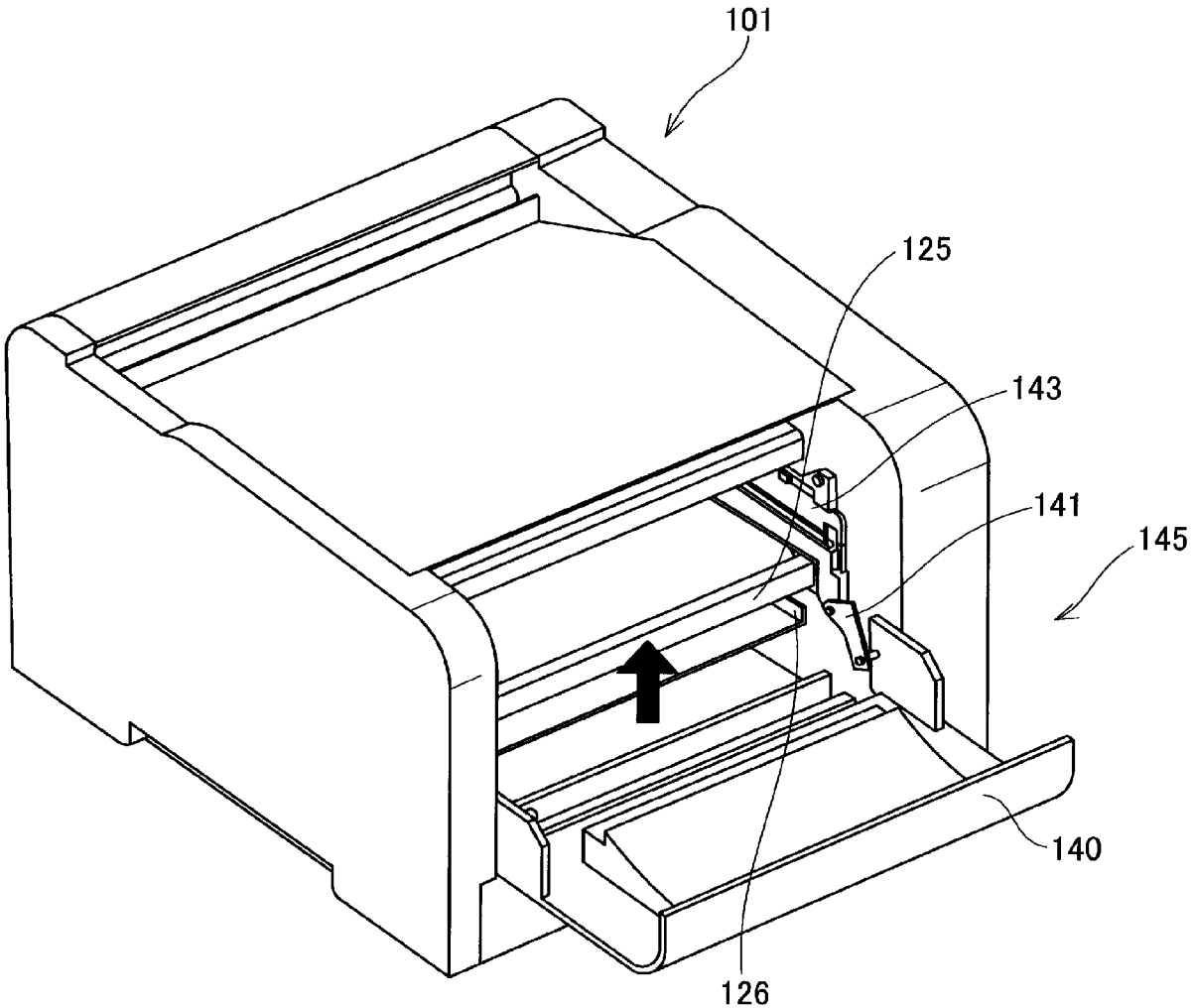

FIG. 7 is a perspective view for illustrating a mount/demounting method of the transfer unit in Embodiment 1.

Figure 8:
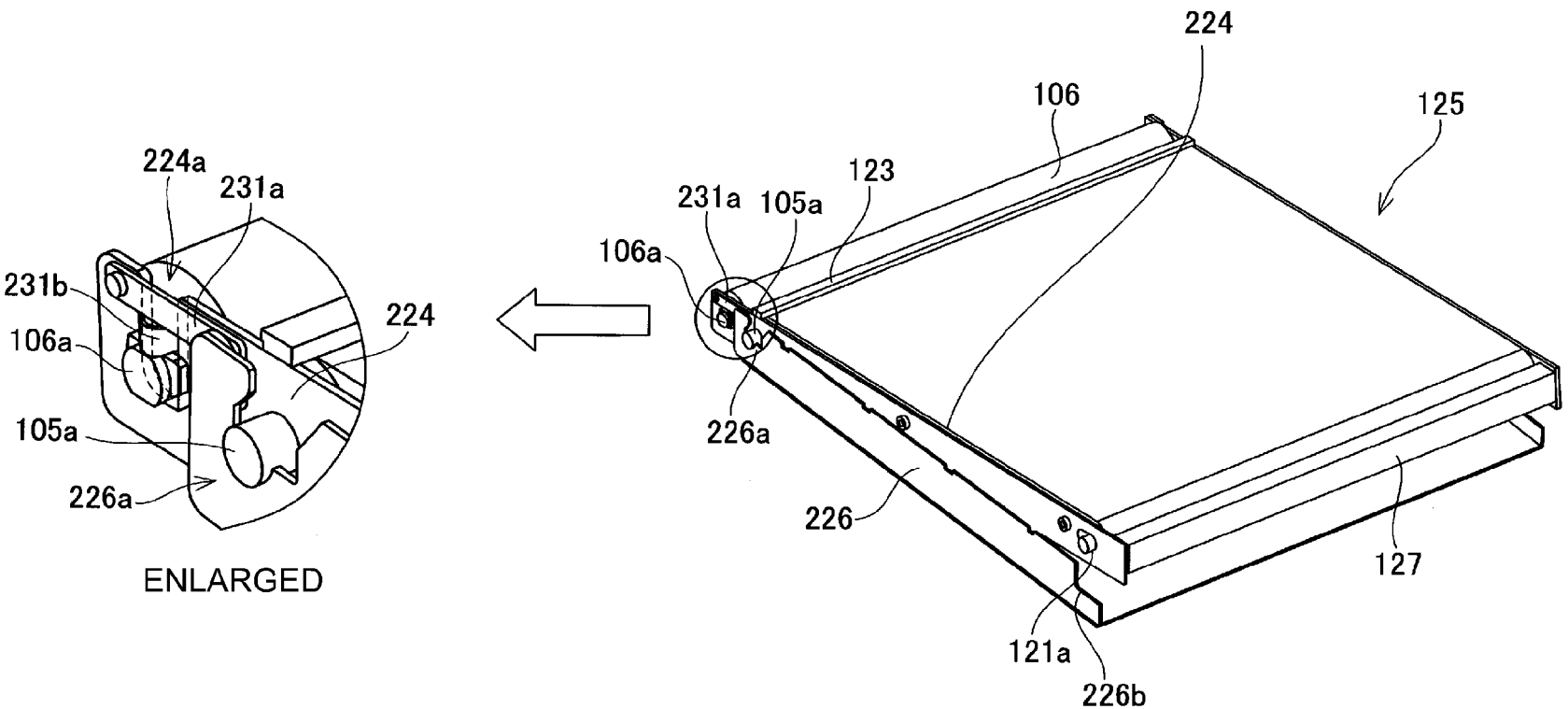

FIG. 8 is a schematic perspective view showing a relationship between a transfer unit and a positioning portion of an apparatus main assembly frame in Embodiment 1.

Figure 9:
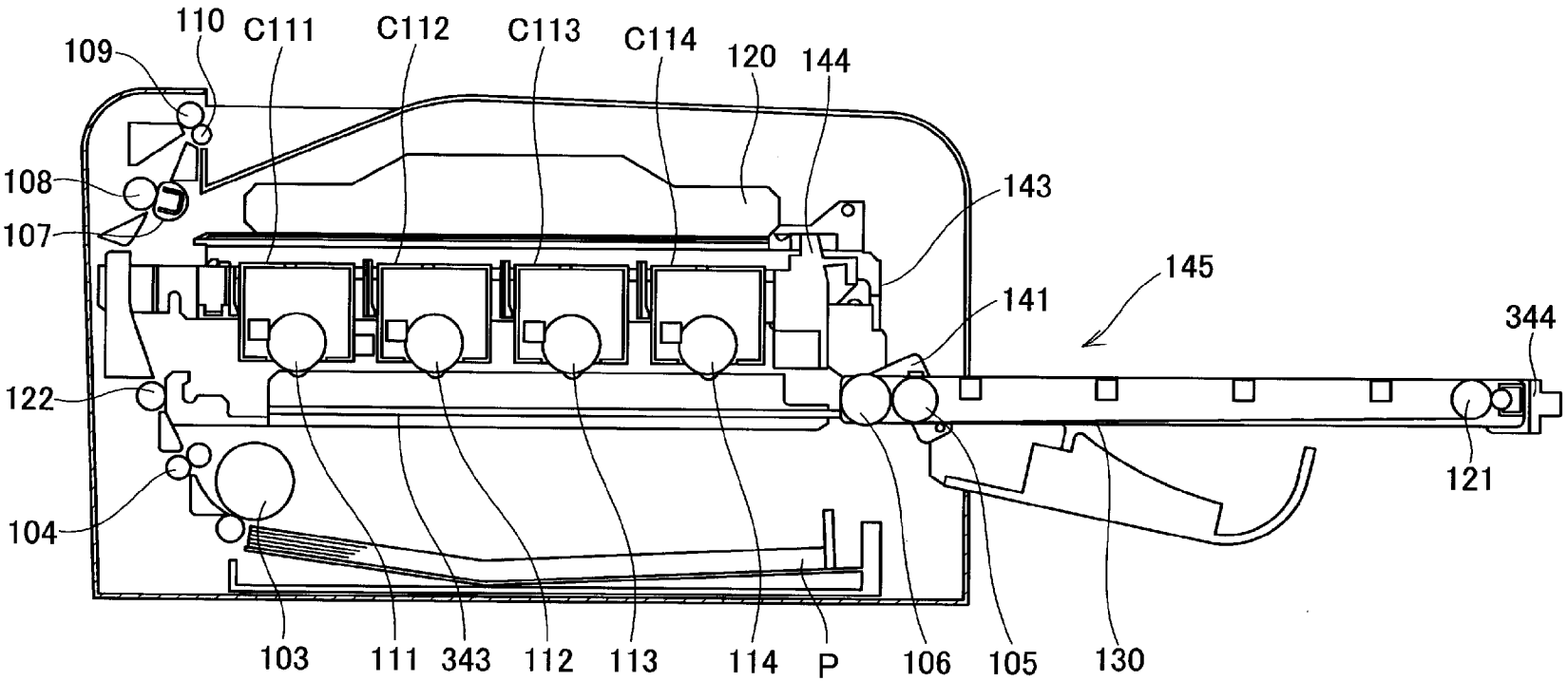

FIG. 9 is a sectional view for illustrating a mount/demounting method of a transfer unit in Embodiment 3.

Figure 10:
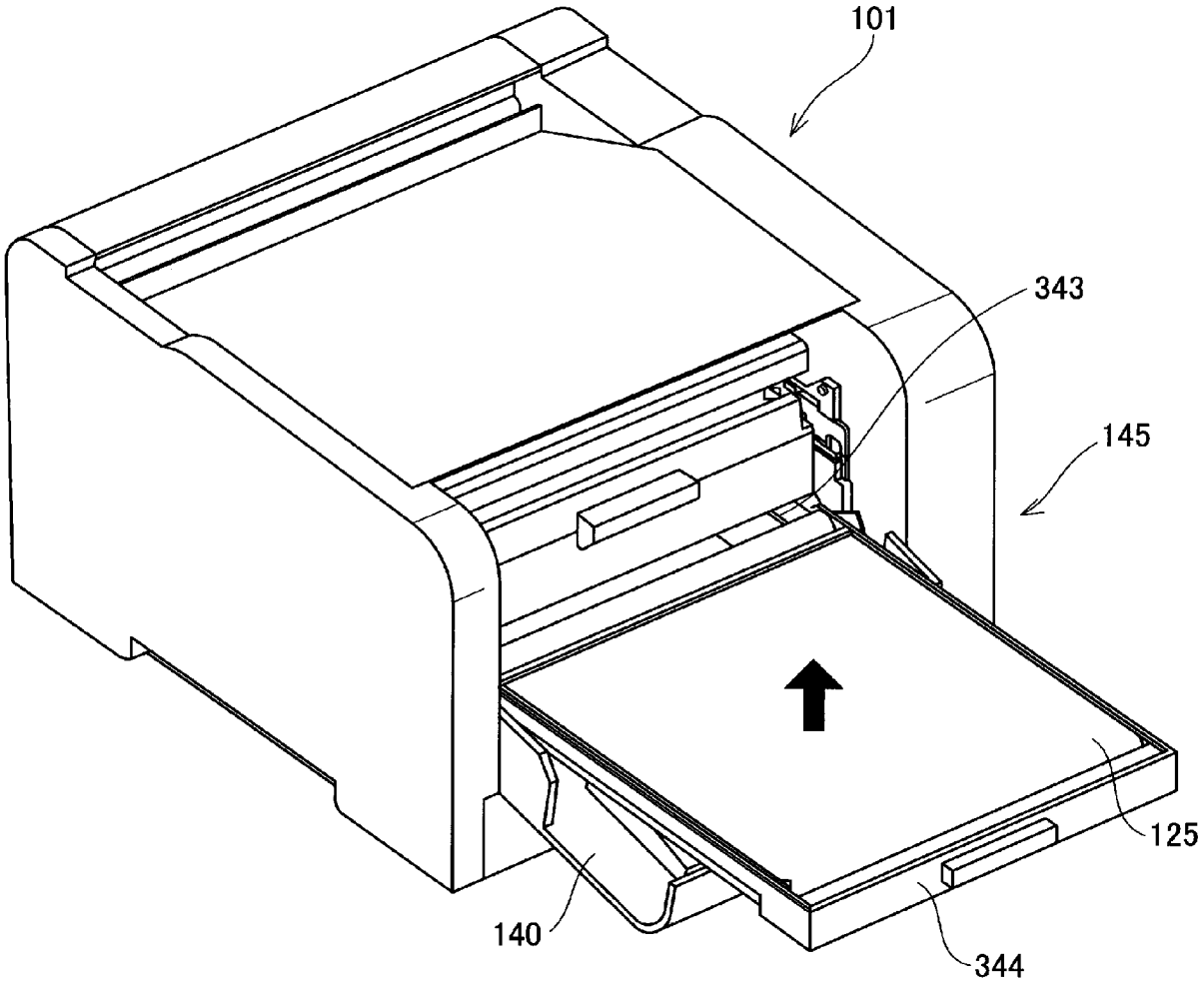

FIG. 10 is a perspective view for illustrating the mount/demounting method of the transfer unit in Embodiment 3.

DESCRIPTION OF THE PREFERRED EMBODIMENTS

Hereinbelow, preferred embodiments of the present invention will be exemplarily and specifically described with reference to the drawings. However, dimensions, materials, shapes, relative arrangements and the like of constituent elements described in the following embodiments are appropriately changed depending on constitutions or various conditions of apparatuses to which the present invention is applied and thus the scope of the present invention is not limited thereto.

Embodiment 1

In this embodiment, a general structure of the image forming apparatus, a mounting/demounting method of process cartridges, a structure of a transfer unit, a positioning constitution of the transfer unit and a mounting/demounting method of the transfer unit will be described in this order. Further, in this embodiment, as the image forming apparatus, a laser beam printer is described as an example. Further, as an example, the image forming apparatus in which respective color toner images (developer images) are successively transferred from photosensitive drums as an image bearing member onto a belt and then are collectively transferred from the belt onto a recording material is described.

(General Structure of Image Forming Apparatus)

Figure 1:
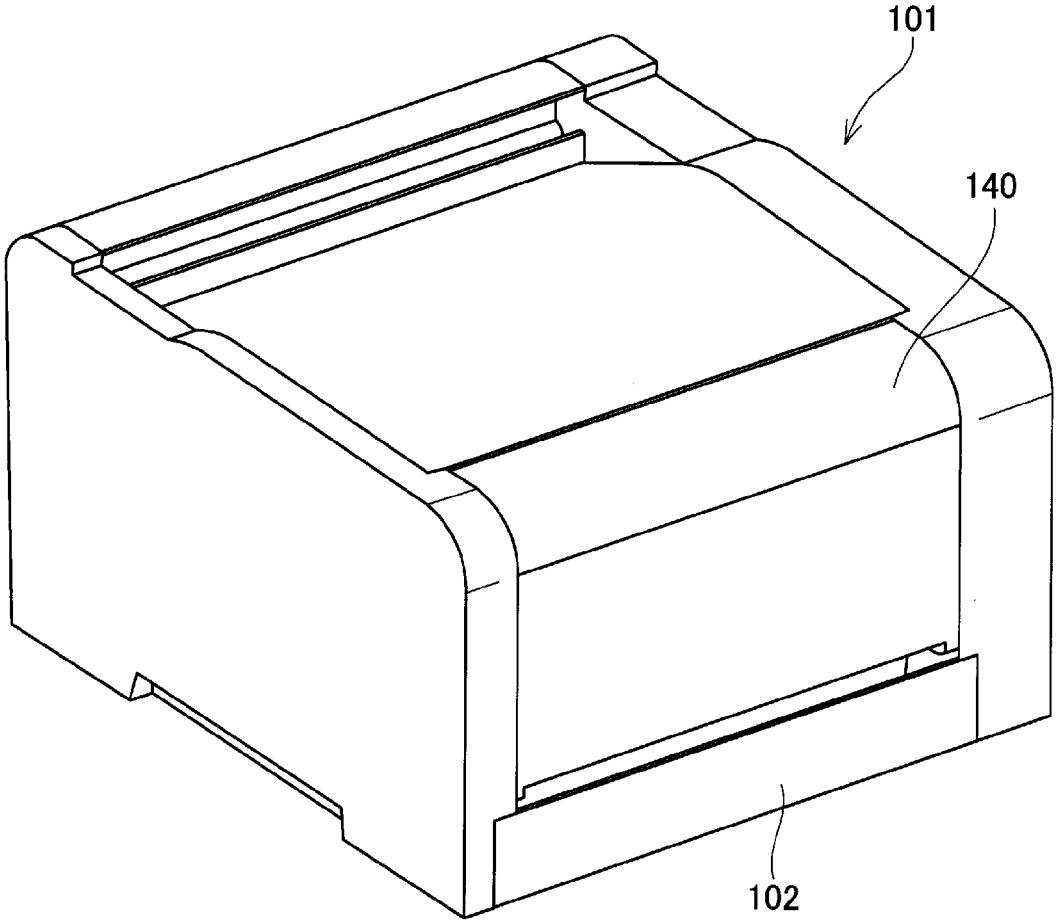
FIG. 1 is a perspective view of an outer appearance of an image forming apparatus in Embodiment 1.
Figure 2:
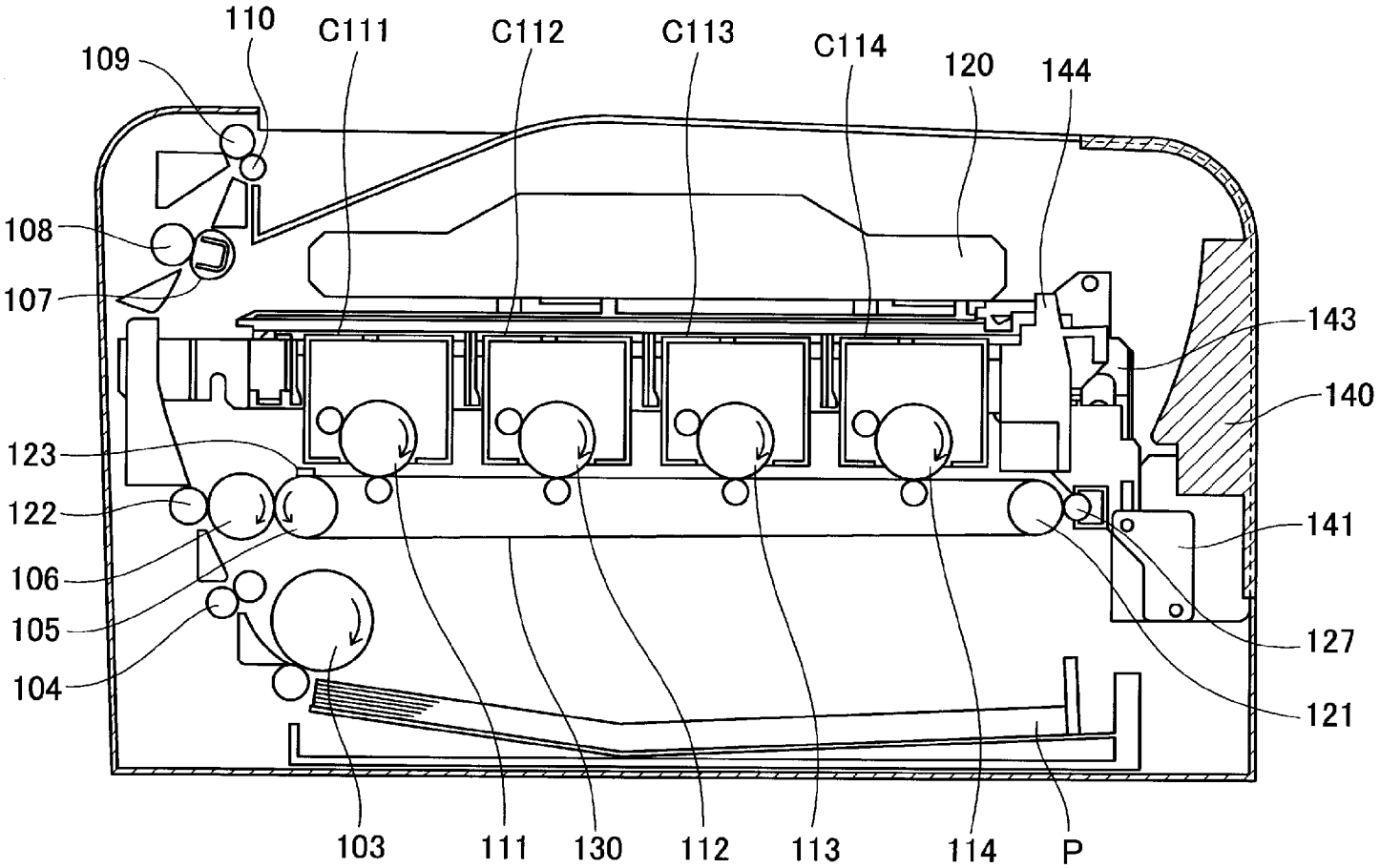
FIG. 2 is a schematic sectional view of the image forming apparatus in Embodiment 1.

FIG. 1 is a schematic perspective view of an outer appearance of the image forming apparatus in this embodiment. FIG. 2 is a schematic sectional view of the image forming apparatus in this embodiment. A recording material P stacked and accommodated in a feeding tray 102 is fed by feeding roller 103 rotating in the clockwise direction in FIG. 2 and is conveyed to a conveying roller 104 and then is conveyed to a nip formed between a second intermediary transfer member 106 and a transfer roller 122 as a tertiary transfer member. Each of photosensitive drums 111, 112, 113 and 114 as the image bearing member provided at each of image forming portions rotates in the clockwise direction in FIG. 2.

At each of the image forming portions, on an outer peripheral surface of the photosensitive drum, an electrostatic latent image is successively formed by laser light from a laser scanner 120 and then is developed by a developing device (developing roller), so that a toner image is formed.

As shown in FIG. 2, in the case where a disposition surface of the image forming apparatus is the bottom, a first intermediary transfer member is provided under the develops 111, 112, 113 and 114 and the laser scanner 120 is provided above the photosensitive drums 111, 112, 113 and 114.

The toner images formed on the photosensitive drums (image bearing members) 111, 112, 113 and 114 are transferred (primary-transferred) onto an intermediary transfer belt 130 as the first intermediary transfer member at primary transfer portions belt the intermediary transfer belt 130 and the respective photosensitive drums 111, 112, 113 and 114. In the case where a color image is formed, the color toner images of yellow, magenta, cyan and black are formed and developed on the photosensitive drums 111, 112, 113 and 114, respectively, and then are successively transferred onto the intermediary transfer belt 130.

Next, at a secondary transfer portion formed between the intermediary transfer belt 130 and the second intermediary transfer member 106, the toner images transferred on the intermediary transfer belt 130 (first intermediary transfer member) are collectively transferred (secondary-transferred) onto the second intermediary transfer belt 106. The second intermediary transfer member 106 is a rotatable roller supported by a bearing. The toner images transferred onto the second intermediary transfer member 106 are transferred (tertiary-transferred) onto the recording material P sent to a nip (tertiary transfer portion) between the second intermediary transfer member 106 and the transfer roller 122.

A rotational movement direction of the intermediary transfer belt 130 as the first intermediary transfer member and a conveyance direction of the recording material P are opposite to each other. Therefore, the rotatable roller 106 as the second intermediary transfer member is contacted to the transfer 122 at a position opposite to a position where the rotatable roller 106 and the intermediary transfer belt 130 from the secondary transfer portion, thus forming the tertiary portion between itself and the transfer roller 122. As a result, the rotational direction of the rotatable roller 106 and the tertiary transfer portion is the same as the conveyance (movement) direction of the recording material P. By employing such a constitution, a toner image movement distance from the primary transfer portion between the upstreammost image bearing member and the intermediary transfer belt 130 to the tertiary transfer portion can be shortened, so that it becomes possible to reduce the FPOT.

Further, the recording material P on which the toner images are transferred is sent to a nip between a fixing film 107 and a pressing roller 108 and is heated and pressed in the nip, so that the toner images are fixed on the recording material P. The recording material P on which the toner images are fixed is discharged by discharging rollers 109 and 110.

Here, the photosensitive drums 111, 112, 113 and 114 are provided detachably mountable to the apparatus main assembly (of the image forming apparatus) in the form of process cartridges C111, C112, C113 and C114, respectively. Each of the process cartridges is prepared by integrally assembling the photosensitive drum and process units, acting on the photosensitive drum, including a charging device, the developing device, the cleaning device and the like into a cartridge (unit), which is detachably mountable to the apparatus main assembly. Further, the photosensitive drums 111 to 114 (process cartridges C111 to C114) are, as shown in FIG. 2, provided in parallel (substantially in one direction) along a belt surface (transfer surface) of the intermediary transfer belt 130.

(Mounting/Demounting Method of Process Cartridge)

Figure 3:
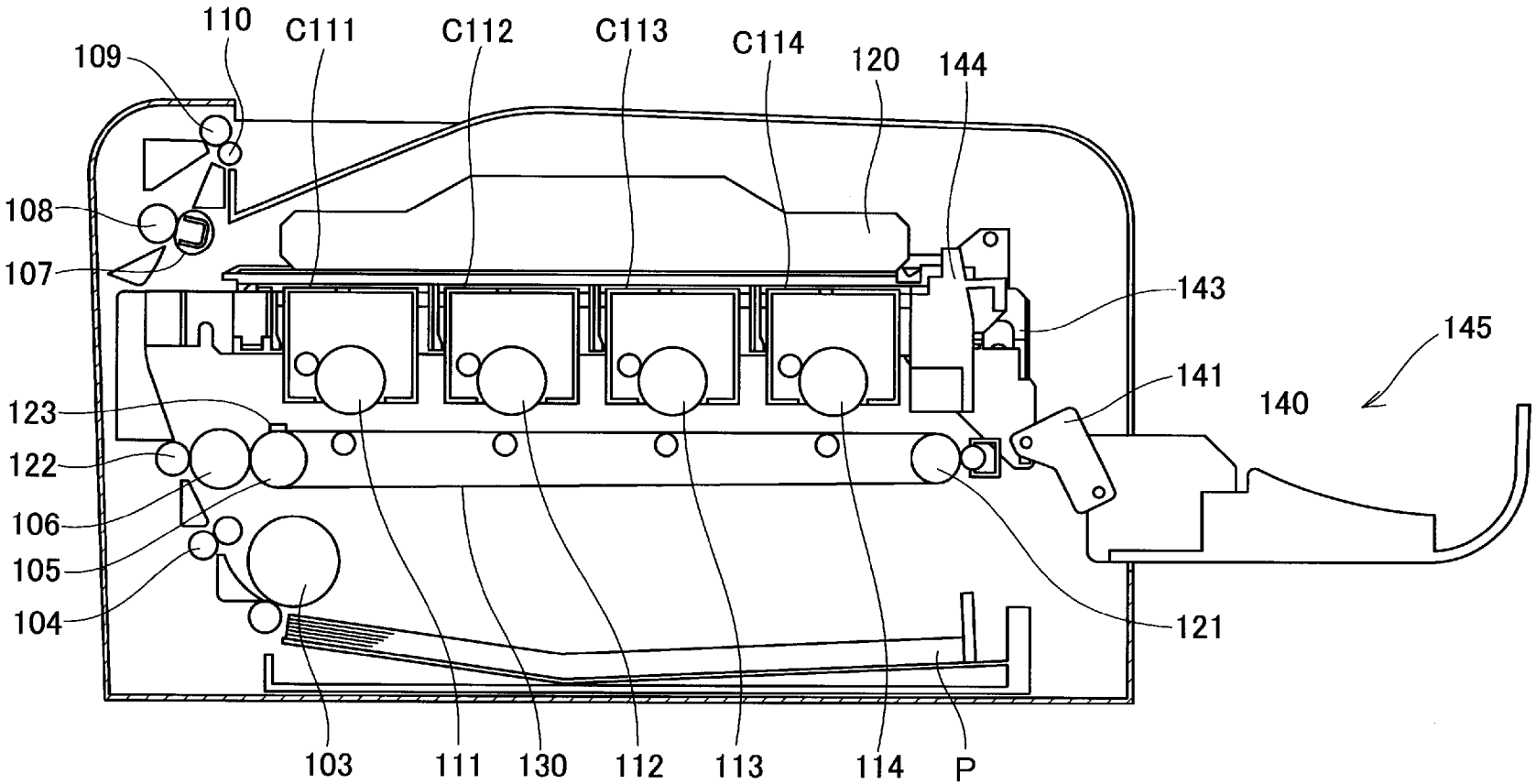
FIG. 3 is a schematic sectional view of the image forming apparatus for which a cartridge door is opened in Embodiment 1.
Figure 4:
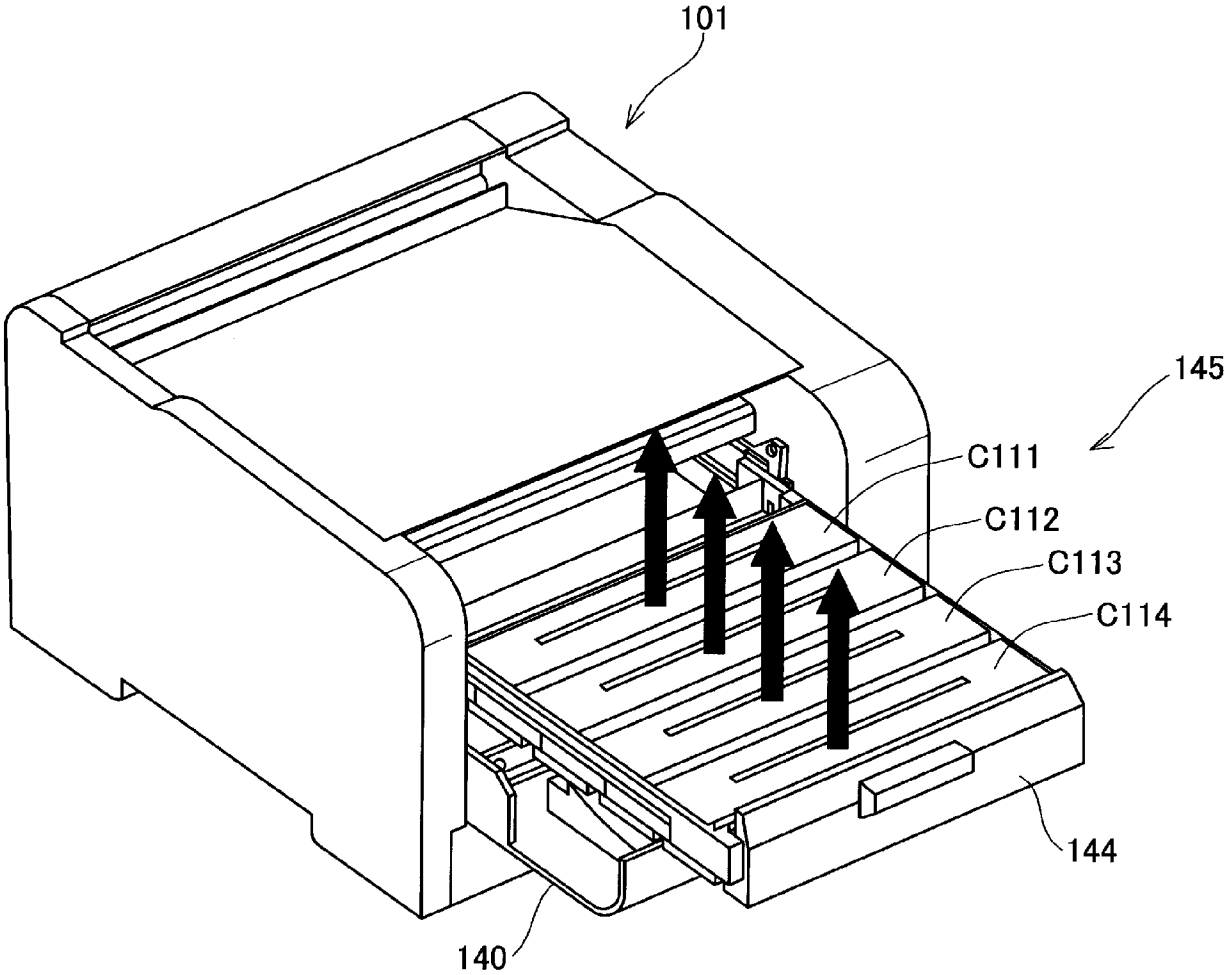
FIG. 4 is a perspective view for illustrating a mount/demounting method of process cartridges in Embodiment 1.

Next, with reference to FIGS. 3 and 4, a summary of the mounting/demounting method of the process cartridges will be described. FIG. 3 is a schematic sectional view of the image forming apparatus in which a cartridge door 140 as an openable member is opened. FIG. 4 is a schematic perspective view for illustrating the mounting/demounting method (replacing method).

In the image forming apparatus in this embodiment, each of the cartridges is replaced (exchanged) by a front-access replacing method, in which the cartridge is placed on a pulling-out tray and a user accesses the cartridge in a front-access manner, in order to improve usability. That is, in a front surface side of the image forming apparatus in this embodiment, an opening 145 for permitting passing of the cartridges in order to insert (mount) the cartridges into an apparatus main assembly 101 and in order to demount the cartridges from the apparatus main assembly 101 is provided. Further, the opening 145 is formed (constituted) by locating the cartridge door 140, at an open position, provided so as to be openable and closable with respect to the apparatus main assembly 101. In this embodiment, the cartridge door 140 is provided so as to be rotatable about a lateral sheet portion 141 in a lower side of the door to be opened and closed relative to the apparatus main assembly 101.

Further, as shown in FIG. 4, the process cartridges C111, C112, C113 and C114 are detachably mounted to a cartridge tray 144 which can be inserted into and pulled-out from the apparatus main assembly 101.

This cartridge tray 144 is horizontally held slidably in a front direction and a rear direction by a pair of tray holding members 143 provided on left and right frames of the apparatus main assembly 101 constituting an apparatus main assembly frame (frame member).

Here, the front direction (side) refers to a direction (side) in which the cartridge tray 144 is pulled out from the apparatus main assembly 101, and the rear direction refers to a direction in which the cartridge tray 144 is inserted into the apparatus main assembly 101. Further, a mounting direction (front-rear direction) in which the cartridge tray 144 is mounted in and demounted from the apparatus main assembly 101 refers to a parallel arrangement direction in which the photosensitive drums 111 to 114 (process cartridges C111 to C114) are juxtaposed (arranged in parallel) along the belt surface (transfer surface) of the intermediary transfer belt 130. Further, left (side) and right (side) refer to those when the apparatus main assembly 101 is viewed from the front side, and correspond to a longitudinal direction of the second intermediary transfer member 106 (axial direction of the second intermediary transfer member or axial direction of the photosensitive drums 111 to 114). The longitudinal direction of the second intermediary transfer member 106 is also referred simply to as the longitudinal direction. A vertical direction in a disposition state of the apparatus main assembly 101 refers to an up-down direction.

In interrelation with an open operation of the cartridge door 140, the tray holding member 144 is moved upward and in the front direction by a predetermined amount. By this movement of the tray holding member 143, the cartridge tray 144 is also moved upward. As a result, the photosensitive drums 111 to 114 are moved upward (spaced) from the intermediary transfer belt 130, so that the cartridge tray 144 is placed in a state in which it can be pulled-out from the apparatus main assembly 101 through the opening 145. Thus, the photosensitive drums 111 to 114 and the intermediary transfer belt 130 are constituted so that the photosensitive drums 111 to 114 are contactable to and separable from the intermediary transfer belt 130.

As shown in FIG. 4, when the cartridge tray 144 is pulled-out from the apparatus main assembly 101, an upper surface of each of the process cartridges C111, C112, C113 and C114 is exposed, so that each process cartridge is demountable in an arrow direction (upward). Further, when the process cartridges C111, C112, C113 and C114 are mounted in the apparatus main assembly 101, a reverse procedure is performed.

(Structure of Transfer Unit)

The structure of the transfer unit 125 will be described with reference to FIGS. 5 and 6. Part (a) of FIG. 5 is a schematic sectional view of the transfer unit, and (b) of FIG. 5 is a schematic side view of the transfer unit. FIG. 6 is a schematic perspective view showing a relationship between the transfer unit and a positioning portion of the apparatus main assembly frame.

The transfer unit 125 includes the intermediary transfer belt 130 (first intermediary transfer member) for forming the plurality of primary transfer portions, together with the photosensitive drums, for permitting transfer of the toner images from the photosensitive drums onto the recording material via the second intermediary transfer member 106. Further, the transfer unit 125 includes an inner belt driving roller 105 for driving the intermediary transfer belt 130 and a tension roller 121 for applying tension to the intermediary transfer belt 130. The inner belt driving roller 105 and the tension roller 121 are stretching rollers for stretching the belt. Further, the transfer unit 125 includes the second intermediary transfer member 106 constituting the secondary transfer portion. Further, the transfer unit 125 is, similarly as in the case of the cartridge tray 144 in which the process cartridges C111 to C114 are mounted, provided so as to movable in the front-rear direction (the parallel arrangement direction of the photosensitive drums) relative to the apparatus main assembly 101. Further, similarly as in the case of the process cartridges, the transfer unit 125 can be inserted into and demounted from the apparatus main assembly 101 via the opening 145.

The inner belt driving roller 105 and the second intermediary transfer member 106 are fixed by a transfer frame 124 constituting a transfer unit main assembly at longitudinal end portions of the second intermediary transfer member 106 via bearing portions 105*a* and 106*a*, respectively.

Further, tension roller 121 is held by the transfer frame 124 via a bearing portion 121*a* in a state in which it is movable in a direction (arrow direction indicated in (b) of FIG. 5) in which the intermediary transfer belt 130 is stretched.

To the transfer frame 124 for holding the tension roller 121, during assembling of the transfer unit 125, the second intermediary transfer member 106 and the inner belt driving roller 105 are positionally fixed by a positioning tool (not shown) at their bearing portions.

Thus, the transfer frame for holding the tension roller 121, the second intermediary transfer member 106 and the inner belt driving roller 105 are integrally assembled into a unit as the transfer unit 125 detachably mountable to the apparatus main assembly 101.

By constituting the transfer unit 125 as described above, the positional accuracy between the second intermediary transfer member 106 and the inner belt driving roller 105 can be ensured with high accuracy and therefore it becomes possible to always perform a stable transfer operation. Further, the positional accuracy between the tension roller 121 and the inner belt driving roller 105 can be ensured and therefore it becomes possible to realize further stable belt movement.

(Positioning Constitution of Transfer Unit)

A positioning constitution of the transfer unit 125 will be described with reference to The transfer unit 125 is positioned by the apparatus main assembly frame 126 constituting the frame of the apparatus main assembly 101. The positioning of the transfer unit 125 relative to the apparatus main assembly frame 126 is performed in the following manner. That is the bearing portion 106*a* of the second intermediary transfer member 106 of the transfer unit 125 and the bearing portion 121*a* of the tension roller 121 for stretching the opposing surface to the photosensitive drums are engaged with positioning portions 126*a* and 126*b* of the apparatus main assembly frame 126, respectively, to perform the positioning.

As a result, an operation for engaging the bearing portions 106*a* and 121*a* of the second intermediary transfer member 106 and the tension roller 121 with the positioning portions 126*a* and 126*b* of the apparatus main assembly frame 126 can be performed more easily.

Further, to the transfer frame 124, a cleaning portion 127 for removing a residual toner remaining on the intermediary transfer belt 130 and a detecting portion 124 for detecting the toner image on the intermediary transfer belt 130 are positionally fixed.

As a result, the positional accuracy between the second intermediary transfer member 106 and the tension roller 121 can be ensured while maintaining the positional relationship among the second intermediary transfer member 106, the tension roller 121, the cleaning portion 127 and the detecting portion 123.

(Mounting/Demounting Method of Transfer Unit)

Next, the mounting/demounting method of the transfer unit 25 will be described with reference to FIGS. 6 and 7. FIG. 7 is a schematic perspective view of the image forming apparatus for illustrating the mounting/demounting (replacing) method of the transfer unit 125.

As described above, the transfer unit 125 is positioned relative to the apparatus main assembly 101 by engaging with the positioning portions 126*a* and 126*b* provided to the apparatus main assembly frame 126. The replacement (exchange) of the transfer unit 125 is performed in a state in which the cartridge door 140 is opened and then as shown in FIG. 7, the cartridge tray 144 is demounted from the apparatus main assembly 101 through the opening 145.

After the cartridge tray 144 is demounted from the apparatus main assembly 101, the front side of the transfer unit 125 is raised in an arrow direction (upward) indicated in FIG. 7.

As a result, the bearing portions 106*a* and 121*a* of the second intermediary transfer member 106 and the tension roller 121 can be disconnected from the positioning portions 126*a* and 126*b* of the apparatus main assembly frame, i.e., the engaging state can be released (eliminated).

Thus, similarly as in the process cartridge, the transfer unit 125 can be demounted forward from the apparatus main assembly 101 through the opening 145. At this time, the transfer unit 125 is moved in the front-rear direction (the parallel arrangement direction of the photosensitive drums or the mounting/demounting direction), so that the transfer unit 125 can be demounted forward from the apparatus main assembly 101.

According to this embodiment, the inner belt driving roller 105, the tension roller 121 and the second intermediary transfer member 106 are integrally assembled into a unit, so that the operativity during the unit replacement can be further improved. Further, by providing the unit, the positional accuracy between the second intermediary transfer member 106 and the intermediary transfer belt 130 (including the inner belt driving roller 105 and the tension roller 121) can be ensured with high reliability, so that the stable transfer operation can be always performed. In this embodiment, in the case where three transfer processes are carried out, attention is directed to no jamming of the recording material between the first intermediary transfer member and the second intermediary transfer member, so that the first intermediary transfer member and the second intermediary transfer member are integrally assembled in the unit as the transfer unit. By employing such a constitution, the process cartridges and the transfer unit can be demounted from one direction and therefore jam clearance can be made simply in the front-access manner, so that usability is improved.

Here, the two transfer frames 124 provided at the longitudinal end portions of the second intermediary transfer member 106 may also be formed with the same part. By using the same part, the positional accuracy among the second intermediary transfer member 106, the inner belt driving roller 105 and the tension roller 121 can be ensured with high accuracy.

Embodiment 2

In this embodiment, the case where the second intermediary transfer member 106 is constituted so as to be detachably mountable to the transfer unit main assembly is described. Incidentally, constituent elements or portions similar to those in Embodiment 1 are represented by the same reference numerals or symbols and will be omitted from description.

(Structure of Transfer Unit)

The structure of the transfer unit 125 will be described with reference to FIG. 8. FIG. 8 is a schematic perspective view showing a relationship between the transfer unit 125 and a positioning portion of the apparatus main assembly 101

To a transfer frame 224 for holding the tension roller 121, during assembling of the transfer unit 125, the second intermediary transfer member 106 and the inner belt driving roller 105 are positionally fixed by a positioning tool (not shown) at their bearing portions. Here, the transfer unit 224 corresponds to the transfer unit transfer frame 224 corresponds to the transfer frame 124 in Embodiment 1.

In this embodiment, the second intermediary transfer member 106 is positionally supported at a cut-away portion 224*a* of the transfer frame 224 (indicated by broken lines) via the bearing portion 106*a*, thus being constituted so as to be detachably mountable to the transfer frame 224 (transfer unit main assembly). Further, the bearing portion 106*a* is fixed (held and supported) by the transfer frame 224 by a pressing member 231*a* and an urging member 231*b*. Here, the cut-away portion 224*a*, the pressing member 231*a* and the urging member 231*b* constitute the supporting portion.

As a result, with respect to the transfer unit 125, the positional accuracy between the second intermediary transfer member 106 and the inner belt driving roller 105 can be ensured with further high accuracy and therefore it becomes possible to always perform a stable transfer operation. Further, the positional accuracy between the tension roller 121 and the inner belt driving roller 105 can be ensured and therefore it becomes possible to realize further stable belt movement.

(Positioning Constitution of Transfer Unit)

A positioning constitution of the transfer unit 125 will be described with reference to FIG. 8.

In this embodiment, the bearing portion 105*a* of the inner belt driving roller 105 and the bearing portion 121*a* of the tension roller 121 of the transfer unit 125 are engaged with positioning portions 226*a* and 226*b* of an apparatus main assembly frame 226 to position the transfer unit 125 relative to the apparatus main assembly 101. Here, the apparatus main assembly frame 226 corresponds to the apparatus main assembly frame 126 in Embodiment 1. Further, the bearing portions 105*a* and 121*a* constitute a positioning portion to be positioned relative to the apparatus main assembly 101.

As a result, an operation for engaging the bearing portions 105*a* and 121*a* of the inner belt driving roller 105 and the tension roller 121 with the position portions 226*a* and 226*b* of the apparatus main assembly frame 226 can be performed more easily.

(Mounting/Demounting Method of Second Intermediary Transfer Member)

The mounting/demounting method of the second intermediary transfer member will be described with reference to FIG. 8.

First, by the method described in Embodiment 1, the transfer unit 125 is demounted from the apparatus main assembly 101. Then, the pressing member 231*a* is released (disconnected) from the bearing portion 106*a*, so that the second intermediary transfer member 106 and its bearing portion 106*a* can be demounted from the cut-away portion 224*a* of the transfer frame 224. When the transfer unit 125 is mounted in the transfer unit 125, a reverse procedure is performed.

Thus, in this embodiment, as the supporting portion for the second intermediary transfer member 106, the cut-away portion 224*a* is provided to the transfer frame 224, and the bearing portion 106*a* of the second intermediary transfer member 106 is fixed to the transfer frame 224 by the pressing member 231*a* and the urging member 231*b*. As a result, it becomes possible to improve the operativity when only the second intermediary transfer member 106 is replaced.

Embodiment 3

This embodiment is characterized by the mounting/demounting method of the transfer unit. In a state in which the process cartridges and mounted in the apparatus main assembly 101, the transfer unit 125 is constituted so as to be detachably mountable to the apparatus main assembly. Incidentally, constituent elements or portions similar to those in Embodiments 1 and 2 are represented by the same reference numerals or symbols and will be omitted from description.

The mounting/demounting method of the transfer unit 125 will be described with reference to FIGS. 8, 9 and 10. FIG. 9 is a schematic sectional view of the image forming apparatus for illustrating the mounting/demounting method of the transfer unit. FIG. 10 is a schematic perspective view of the image forming apparatus for illustrating the mounting/demounting.

(Mounting/Demounting Method of Transfer Unit)

The replacement of the transfer unit 125 is, in order to improve usability, of the front-access replacement type in which the transfer unit 125 is placed on the tray in the state, in which the process cartridges are mounted, and then is pulled-out in the forward direction.

In this embodiment, as shown in FIG. 10, the transfer unit 125 is detachably mounted to a transfer unit tray 344 to be inserted into and pulled-out from the apparatus main assembly 101.

In this case, the positioning the transfer unit 125 relative to the apparatus main assembly 101 is made by being directly positioned to the apparatus main assembly frame 126 without via the transfer unit tray 344, so that the positional accuracy of the transfer unit 125 relative to the apparatus main assembly 101 can be ensured with high accuracy similarly as in Embodiments 1 and 2. The transfer unit tray 344 is horizontally held slidably in the front-rear direction by a pair of transfer unit tray holding members 343 provided on left and right frames of the apparatus main assembly constituting the apparatus main assembly frame 126.

Similarly as in Embodiment 1, the tray holding member 143 is moved upward and in the front direction by a predetermined amount (distance) in interrelation with an open operation of the cartridge door 140. By this movement of the tray holding member 143, the cartridge tray 144 is also moved upward. The movement amount at this time is T1.

Further, the transfer unit tray holding member 343 is moved upward and in the front direction by a predetermined amount (distance) in interrelation with an open operation of the cartridge door 140. By this movement of the transfer unit tray holding member 343, the transfer unit tray 344 is also moved upward. The movement amount at this time is T2.

In this case, T1>T2 is satisfied, so that the photosensitive drums 111 to 114 can be constituted so as to be separated (spaced) from the intermediary transfer belt 130. Thus, the intermediary transfer belt 130 and the photosensitive drums 111 to 114 are placed in the separation state. As a result, the transfer unit 125 is movable in the mounting/demounting direction (front-rear direction), thus being demountable from the apparatus main assembly 101 through the opening 145. Further, at this time, as shown in FIG. 9, the second intermediary transfer member 106 is disposed below the photosensitive drums 111 to 114, and the transfer unit 125 is placed in a state in which the transfer unit 125 can be pulled out from the apparatus main assembly in which the process cartridges are mounted.

Here, the disposition of the second intermediary transfer member 106 below the photosensitive drums means that the second intermediary transfer member 106 is disposed closer to the intermediary transfer belt 130 than the photosensitive drums, in the cross-section shown in FIG. 9, with respect to the direction perpendicular to the mounting/demounting direction (the movement direction or the parallel arrangement direction of the photosensitive drums). This also means that the transfer unit 125 is disposed at a position where it does not interfere with the photosensitive drums when the transfer unit 125 is moved in the mounting/demounting direction and then is mounted in and demounted from the apparatus main assembly 101.

When the transfer unit 125 is mounted in the apparatus main assembly 101, a reverse procedure is performed.

Thus, in this embodiment, the mounting/demounting of the transfer unit 125 is performed by the pulling-out method. Further, in the state in which the transfer unit 125 is movable in the mounting/demounting direction, the second intermediary transfer member 106 is positioned below the photosensitive drums, so that the transfer unit 125 can be mounted in and demounted from the apparatus main assembly 101 in which the cartridges are mounted as they are and thus the usability is further improved.

Further, when the transfer unit 125 is movable in the mounting/demounting direction, the second intermediary transfer member 106 is positioned below the photosensitive drums, so that the height of the apparatus main assembly 101 can be reduced. Incidentally, in this embodiment, the constitution in which the transfer unit is moved upward during the mounting/demounting of the transfer unit is described but a positioning constitution with no movement in the up-down direction may also be employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 137488/2011 filed Jun. 21, 2011, which is hereby incorporated by reference.

What is claimed is:

1. An image forming apparatus comprising:

a plurality of image bearing members, provided in parallel with each other, each for forming a toner image;

a transfer unit detachably mountable to a main assembly of said image forming apparatus and including a first intermediary transfer member and a second intermediary transfer member, wherein said first intermediary transfer member forms a primary transfer portion between itself and each of said plurality of image bearing members, wherein the toner images formed on said plurality of image bearing members are to be primary-transferred onto said first intermediary transfer member, and wherein the toner images are to be secondary-transferred from said first intermediary transfer member onto said second intermediary transfer member;

a transfer member for tertiary-transferring the toner images from said second intermediary transfer member onto a recording material, wherein said first intermediary transfer member includes a rotatable belt and a plurality of stretching rollers for stretching the belt, wherein said transfer unit is mountable in and demountable from the main assembly with respect to a direction parallel to a rotational direction of the belt, and wherein said first intermediary transfer member and said second intermediary transfer member are arranged in a mounting and demounting direction of said transfer unit, and further comprising an apparatus main assembly frame forming the main assembly of said image forming apparatus, wherein said apparatus main assembly frame comprises a positioning portion for positioning said transfer unit relative to said apparatus main assembly, wherein said transfer unit comprises a transfer frame on both sides thereof with respect to a direction perpendicular to the rotational direction of the belt, and wherein the positioning portion is engageable with each of bearing portions of the stretching rollers and said second intermediary transfer member.

2. An apparatus according to claim 1, further comprising an openable member openable and closable with respect to the main assembly of said image forming apparatus, wherein said transfer unit is movable, through an opening opened and closed by said openable member.

3. An apparatus according to claim 1, wherein shafts of the stretching rollers and a shaft of said second intermediary transfer member are supported by said transfer frames.

4. An apparatus according to claim 1, wherein said second intermediary transfer member is detachably mountable to said transfer unit.

5. An apparatus according to claim 4, wherein said second intermediary transfer member is detachably mountable to said transfer frame.

6. An apparatus according to claim 1, wherein said first intermediary transfer member and said plurality of image bearing members are configured to be contactable to and separable from each other, and wherein said first intermediary transfer member and said plurality of image bearing members are separated from each other so that said transfer unit is detachably mountable to said apparatus main assembly frame.

7. A transfer unit, detachably mountable to an image forming apparatus, including a plurality of image bearing members, each for forming a toner image, and an apparatus main assembly frame having a positioning portion, said transfer unit comprising:

a first intermediary transfer member for forming a primary transfer portion between itself and each of the plurality of image bearing members, wherein the toner images formed on the plurality of image bearing members are to be primary-transferred onto said first intermediary transfer member;

a second intermediary transfer member onto which the toner images are to be secondary-transferred from said first intermediary transfer member; and transfer frames supporting said first and second intermediary transfer members, wherein said first intermediary transfer member and said second intermediary transfer member are integrally assembled into said transfer frames, wherein said second intermediary transfer member is detachably mountable to said transfer frames, and wherein a bearing portion of said second intermediary transfer member is engagable with the positioning portion on the apparatus main assembly frame.

8. A transfer unit according to claim 7, wherein said first intermediary transfer member is an intermediary transfer belt, capable of being rotated and moved, stretched by a stretching roller.

9. A transfer unit according to claim 8, wherein said transfer frames are provided on both ends of said first and second intermediary transfer members with respect to a direction perpendicular to the rotational direction of said intermediary transfer belt, the stretching roller for stretching the intermediary transfer belt, and a rotatable roller as said second intermediary transfer member.

10. A unit according to claim 9, wherein shafts of the stretching roller and the rotatable roller are supported by said transfer frames.

* * * * *